United States Patent [19]

Wakayama

[11] Patent Number: 4,527,084

[45] Date of Patent: Jul. 2, 1985

[54] RADIATION COUNTER

[76] Inventor: Naoaki Wakayama, 765-1, Oaza Funaishikawa, Tokaimura, Nakaimura, Nakagun, Ibaragi, Japan

[21] Appl. No.: 31,921

[22] Filed: Apr. 20, 1979

[30] Foreign Application Priority Data

Apr. 21, 1978 [JP] Japan ..... 53-47291

[51] Int. Cl.[3] ..... H01J 47/00

[52] U.S. Cl. ..... 313/93

[58] Field of Search ..... 313/93

[56] References Cited

U.S. PATENT DOCUMENTS 2,141,655 12/1938 Kott ..... 313/93
2,503,302 4/1950 Shore ..... 313/93
2,512,773 6/1950 Herzog et al. ..... 313/93
2,884,529 4/1959 Eggler et al. ..... 313/93 X
3,767,955 10/1973 Johnson ..... 313/93 X
3,892,990 7/1975 Mitrofanov ..... 313/93

*Primary Examiner*—David K. Moore

[57] ABSTRACT

A radiation counter comprises; electrodes made of nickel base super alloy containing the nickel in the weight ratio exceeding 30% and not exceeding 90% and the chrome, the iron, etc. as the balance; and counter gas in which the argon gas is the chief ingredient and with which the nitrogen gas is mixed in the volume ratio exceeding 2% and not exceeding 30%. The counter operates stably at a high temperature exceeding 450° C., affords relatively large output pulse current and has short electron-collection-time characteristics.

1 Claim, 1 Drawing Figure

RADIATION COUNTER

BACKGROUND OF THE INVENTION (1) Field of the Invention

This invention relates to a radiation counter which can be used in a high temperature environment and, particularly, a radiation counter technique which can realize radiation counters with extremely high effectiveness that satisfy the specification required at an operating temperature exceeding 450° C., afford a large pulse amplitude of the output pulse current and have a short collection time of electron charge (hereinafter, referred to as "a short electron-collection-time").

(2) Description of the Prior Art

In the radiation counter of the prior art, such as the nuclear fission counter, that was used nearly at the ordinary temperature or at the medium temperature range not exceeding about 450° C., fast electron-collection-gases containing the argon gas with some amount of the diatomic gas or the polyatomic gas are generally used as the counter gas to obtain good operating performances, such as the large output pulse current and the short electron-collection-time, of the counter. The argon gas containing the carbonic acid gas of 2% to 5% in volume and the nitrogen of 1% to 2%, for examples, are well known as such fast electron-collection-gases. Sometimes, the fast electron-collection-gas is simply called as the fast counter gas. The reason why such good operating performances of the counter are obtained when the fast counter gas is used is that the electron drift velocity in these fast counter gases is relatively very high compared with that in the innert gas such as the pure argon gas and, naturally, in the counter operating performances, the electron-collection-time becomes short and the induced pulse current of the counter electrode or the output current of the counter is large.

Meanwhile, in the advanced nuclear power reactors, such as the fast breeding reactors (hereinafter, referred to as FBRs) and the high temperature gas cooled reactors (hereinafter, referred to as HTGRs), etc. that are recently being developed, the core temperature of those reactors becomes to be designed very high to enhance the heat utilization efficiency of the reactors and the reactor development programs require, for the reactor control purpose, to develop the heat-resisting nuclear radiation counters, especially neutron counters which can be used in such high temperature environment in those reactors. In order to cope with this situation, many efforts to increase heat-resistivity of the radiation counters are continued in many countries in the world. As some results of these efforts, high temperature radiation counters wherein the operating temperature exceeds 450° C. are developed in England (e.g. P 7A type fission counter) and in France (e.g. CFU-12 type fission counter).

Pure argon gas is, however, used as the counter gas in the high temperature heat-resisting radiation counters of the prior art such as mentioned above and, therefore, the amplitude of the output pulse currect of those counters is about one-third as small as and the electron-collection-time is about three times as long as those of the same kind of counters that are designed to be used at the ordinary and/or medium temperature ranges up to 450° C. This is the serious defect in the operating performance of the high-temperature heat-resisting radiation counters of the prior art as described later.

In the prior art, it is widely believed that the high temperature radiation counter filled with the fast electron-collection-gas cannot be used in the high temperature environment exceeding 450° C. as described in page 21 of the literature "Neutron Detectors for Reactor Control" written by D. J. Mobbs, J. Inst. Nucl. Eng., Vol. 18, No. 1, pp 16 to 25, 1977. The fast electron-collection-gas is composed of inert gases as the chief ingredient and some amount of the diatomic gas or the polyatomic gas, such as the nitrogen and the carbon acid gas. However, in the conventional radiation counters, those mixed gases present phenomena to react with the electrodes and the structural metal in the high radiation and high temperature environment exceeding 450° C. More particularly, the nitrogen is easily absorbed into the electrodes etc. through the nitrogenizing process and the carbon acid gas is dissolved and also absorbed into the metal structure in a short time through the carbonizing and sintering process in such rigorous and stern environment. By this reason, as the contents of the diatomic gas and the polyatomic gas in the counter gas are rapidly decreased in such rigorous and stern environment, the character of the gas in the counter, such as the electron drift velocity in the gas etc. is substantially changed and no stable operation an naturally be maintained in the ordinary radiation counters of the prior art.

The problems to be caused by the fact that the collection time of the radiation counter becomes long and the output pulse current small are described hereinafter. The short electron-collection-time characteristics of the counter is, of course, important to reduce the pulse pile-up in the counter itself. However, in case that the amplitude of the output pulse current of the counter becomes small, it further affects remarkably to the overall performances of the counting system in which the counter is used.

If the amplitude of the output pulse currect of the counter is decreased by a factor 1/n, the pulse-shaping time constants of the pulse amplifier must be, in general, increased by a factor $n^2$ under the same condition of the signal-to-noise ratio, because the frequency bandwidth of the amplifier is inversely proportional to the shaping time constant, while the amplitude of the output noise is proportional to a square-root of the bandwidth of the amplifier.

Consequently, since the pulse-width broadens by a factor $n^2$ and the pulse pile-up probability also increases by a factor $n^2$, the maximum counting rate that can be measured decreases to $1/n^2$ and, furthermore, the permissible maximum fluence rate of the background radiation, such as gamma-rays and alpha-rays in neutron measurement, also decreases to $1/n^2$. Thus, as the performance of the counting system is largely affected by the amplitude of the output pulse current of the radiation counter used, various efforts have been made in various countries in the world to develop high performance and heat-resisting nuclear radiation counters satisfying both the large pulse current output-characteristics and high temperature stability. However no one succeeded in this development.

SUMMARY OF THE INVENTION

A construction to obtain high-performance radiation counters is shown in the present invention, in which a high-temperature heat-resistivity and a characteristic of affording large output pulse current are obtained simultaneously, the realization of the performance being, up to now, expected for a long time, as stated above.

According to the present invention, a high-temperature and heat-resisting radiation counter is realized, in which stable operation can be obtained at a high radiation level and in a high temperature environment, such as 600° C., and large output pulse current and short collection time of electron charge are afforded.

DESCRIPTION OF THE PREFERRED EMBODIMENT

Figure 1:
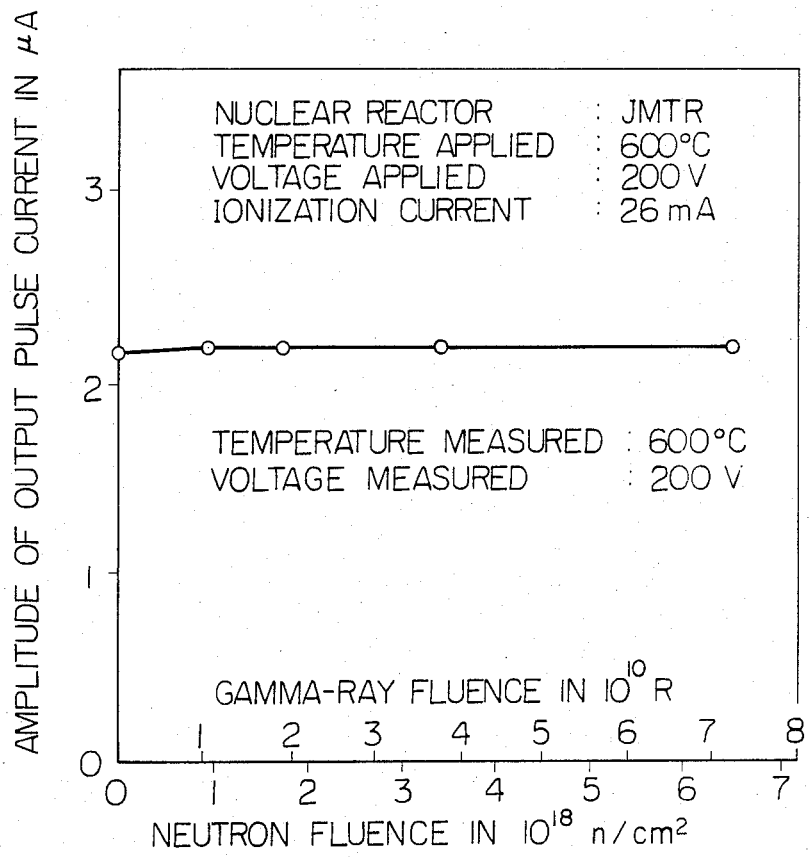
FIG. 1 shows an example of the result of the nuclear irradiation life test under a high temperature environment for a nuclear fission counter manufactured in accordance with the present invention. In the FIGURE, the amplitude of the output pulse current of the counter is shown as a function of the irradiated neutron fluence and the gamma-rays fluence.

The details of the present invention is explained in detail hereinafter.

The characteristic feature of the high temperature radiation counter of the present invention is in that the electrodes of the counter is made of a nickel base super alloy in which the nickel is involved in the weight ratio exceeding 30% and not exceeding 90% and the chrome, the iron, etc. are involved as the balance and the nitrogen gas is mixed with the counter gas, in which the argon gas is the chief ingredient, in the volume ratio exceeding 2% and not exceeding 30%.

The reason why an alloy of high nickel content is used as the electrode material is that since the thickness of the nitrogenized layer of the alloy surface is maintained extremely thin under high temperature and high radiation and the growth of the nitrogenized layer into the inside of the alloy is scarcely observed, the reduction of the nitrogen component in the counter gas due to the absorption of nitrogen gas to the counter electrodes through nitrogenation is kept minimum.

The nitrogen in the counter gas, therefore, can exist without being absorped even under an environment of high temperature of 450° C. to 600° C. and of high nuclear radiation level and the drift velocity of the electron in the counter gas can also be maintained at a high level. Consequently, the superior counter characteristics that the output pulse current of the radiation counter is large and the electron-collection-time is short, can be stably maintained even under the very high temperature environment such as at 600° C.

Meanwhile, when the counter is used in very high level of nuclear radiation environment, it must be considered that the electrode temperature exceeds sometimes 700° C. through the nuclear radiation heating by the high dose rate of gamma rays and/or the neutron irradiation even when the temperature of the surroundings or the surface of the counter is kept at around 600° C. Under the circumstance stated above, the slow growth of the nitride layer into the inside of the electrode cannot be completely arrested even if the electrode of the nickel base super alloy referred to above is used and a steady nitrogenized layer is formed over the surface of the electrodes.

Furthermore, under such high radiation environment, the nitrogen contained in the counter gas is rapidly and successively ionized and the ionized nitrogen atoms are accelerated by the electric field applied between the electrodes and iteratively impinge on the counter electrodes. It results that some nitrogen will be absorbed, accordingly, under such circumstance, into the nitrogenized layer on the surface of the electrodes that have initially been in an equilibrium condition to the nitrogen in the counter gas.

As a countermeasure, the working life of the counter at such high temperature condition can be extended by increasing the nitrogen contents in advance than the socalled best contents of the nitrogen to give the best performances in an ordinary temperature range, that is 1% to 2% of the nitrogen mixing ratio to the argon of the counter gas.

Any excess mixing of the nitrogen, however, lowers naturally the electron drift velocity and degrades, substantially, the pulse output characteristics of the counter at the initial usage and, therefore, the nitrogen mixing ratio not exceeding 30% is the extent that is practically advantageous.

Now explaining, with reference, about the structural metal of which counter vessel and various metal parts such as the supporting structure of the electrodes and insulators are made. It does not always need to use the same alloy as the electrodes for the construction, since the probability of impinge of the ionized and activated nitrogen atoms onto the metallic construction is lesser than that onto the electrodes. Stabler characteristics of the counter at higher temperature in longer duration can be obtained, if the nitrogen absorption onto the metallic construction is decreased, even in a small measure, by using nickel-alloys the same as the electrodes.

A detailed example and the operational effect obtained from the actual experiment are explained in the following with reference to a case in which the principle of the present invention is applied to nuclear fission counters.

In the actual experiment, stated above, the metallic parts of the electrodes and the counter vessel etc. of the fission counter are made of a nickel base upon alloy containing the nickel of 78%, the chrome of 16%, the iron and the balance of 6% in weight, and the argon gas mixed with the nitrogen of 5% in volume is used as the counter gas.

The main dimensions of the counter such as the electrode spacing and the counter gas pressure filled into the counter are, respectively, 1 mm and 7 atm, and are substantially the same as those of the prior art, such as the British type high temperature fission counter. As the experimental results, in the high temperature fission counter, thus manufactured in accordance with the construction of the present invention, as stated above, a stable operation was obtained at a high temperature of 600° C. and the amplitude of the output pulse current was 2.2 $\mu$A at the mode (at most frequent value) in the pulse amplitude distribution and electron-collection-time was 100 n sec.

It will be found that the characteristics obtained above are superior to the high temperature fission counter of the prior art to which a specification exceeding 450° C. can be applied, by 2.5 to 3 times and the output performance obtained above is similar to that of ordinary fission counter which is designed and manufactured to operate only in a common temperature range or medium temperature range up to 450° C.

As stated above, the present invention is extremely different from an invention obtained from the common sense of the prior art in the fact that the counter gas containing the nitrogen, which is not the inert gas, is used even for the high temperature radiation counter to be operated at the temperature exceeding 450° C. Therefore, in order to prove that the performance of the radiation counter based on the present invention can, in fact, be maintained under a high temperature and high radiation environment through a long period, a nuclear fission counter manufactured in accordance with the present invention as stated above was mounted in the reactor core of the material testing reactor JMTR and an accelerating irradiation life test was carried out.

The surface temperature of the fission counter to be tested was controlled and kept at 600° C. during the irradiation life test period. In this case, by the calculation base on the intensity of neutron and gamma rays in the counter, the inner electrode temperature of the counter was estimated to be kept approximately at 700° C. during the irradiation. Furthermore, a polarizing voltage of 200 V was continuously applied between the electrodes and an ionization current of 26 mA was successively flowed, to accelerate the degradation of the counter gas caused by absorption of the nitrogen into the electrodes.

The total neutron fluence and the total gamma-ray fluence irradiated during the life test period were $6.5\times10^{18}$ n/cm$^2$ and $7.2\times10^{10}$ R, respectively.

FIG. 1 shows one of the test results obtained in the irradiation life test of the counter and variation of the output pulse current at 600° C. is shown as a function of the irradiated neutron fluence and gamma-ray fluence. The abscissa shows the neutron fluence and the gamma-ray fluence and the ordinate shows the amplitude of the output pulse current (shown as the mode) of the fission counter at the corresponding irradiation fluences. As can be seen from the test results shown in FIG. 1, the amplitude of the output pulse current of the fission counter of the present invention does scarcely change even at 600° C. till the end of the irradiation test.

The total neutron fluence irradiated to the counter in this irradiation life test corresponds to the neutron fluence to be irradiated during about 2,000 years on an assumption that the counter is used as the sensor of a reactor start-up channel and is continuously used at the maximum neutron flux density of $1\times10^{18}$ n/cm$^2$ sec (at the maximum counting rate of $1.2\times10^7$ count/sec). The total neutron fluence irradiated in this test also corresponds to the neutron fluence to be irradiated during about 20 years on an assumption that the counter is continuously used under a condition that the neutron flux density is $1\times10^{10}$ n/cm$^2$ sec, as a D.C. ionization chamber or a neutron detector for a wide range monitoring channel composed of a pulse counting channel and a campbelling channel by the mean square method. Accordingly, it can be said that the stability of the amplitude of the output pulse current and the operation life of the fission counter manufactured in accordance with the present invention are sufficient for practical usages in the high temperature and high level radiation environment in the reactors.

The effectiveness of the present invention was actually shown by the experimental test results as explained above, and, thus, it becomes quite clear that a radiation counter having extremely high performance can be obtained, which satisfies both a high pulse-output-performance that is obtained only with the counters designed to operate up to 450° C. in the prior art and a high heat-resistivity-performance as can operate stably at 600° C.

In conclusion, the high temperature radiation counter of the present invention is highly useful in nuclear reactors, such as the HTGRs and the FBRs which have high temperature reactor core, especially, in improving the performance of the nuclear instrumantation systems for the reactor control and protection for these reactors, in improving the reactor safety due to the above results, in improving the economical performance due to the fact that no local cooling systems for the counters are needed even if the counters are equipped at locations of high temperature environment in the reactor vessel and in simplifying the reactor construction. In other words, the high temperature radiation counter of the present invention is, actually, very useful for the future reactor programs in the world.

I claim:

1. A radiation counter comprising; counter electrodes made of nickel base super alloy containing the nickel in the weight ratio exceeding 30% and not exceeding 90% and the chrome, the iron, and other constituents as the balance; and counter gas in which the argon gas is the chief ingredient and with which the nitrogen gas is mixed in the volume ratio exceeding 2% and not exceeding 30%, whereby the radiation counter operates stably at a high temperature atmosphere exceeding 450° C. and affords relatively large pulse output current and short electron-collection-time.

* * * * *